US005090646A

United States Patent [19]

Pucillo

[11] Patent Number: 5,090,646

[45] Date of Patent: Feb. 25, 1992

[54] SUPPORT AND POSITIONING ASSEMBLY FOR A SPRAY NOZZLE

[76] Inventor: Robert L. Pucillo, P.O. Box 557442, Miami, Fla. 33155-7442

[21] Appl. No.: 531,307

[22] Filed: May 31, 1990

Related U.S. Application Data

[62] Division of Ser. No. 302,487, Jan. 27, 1989, Pat. No. 4,988,063.

[51] Int. Cl.[5] ..... A62C 13/76

[52] U.S. Cl. ..... 248/75; 248/279

[58] Field of Search ..... 248/657, 662, 75, 72, 248/57, 660, 669, 82, 231.5, 279, 278, 286, 298, 342

[56] References Cited

U.S. PATENT DOCUMENTS

| | | | |
|---|---|---|---|
| 438,027 | 10/1890 | Smith | 248/669 X |
| 790,506 | 5/1905 | Kuzel | 248/660 |
| 961,054 | 6/1910 | Willis | 248/75 |
| 1,577,607 | 3/1926 | Blaw | 248/75 X |
| 1,637,523 | 8/1927 | Hamilton | 248/82 |
| 2,032,940 | 3/1936 | Lawrence | 248/669 |
| 2,754,087 | 7/1956 | Johnson | 248/654 X |
| 4,619,427 | 10/1986 | Leymann | 248/657 X |
| 4,717,099 | 1/1988 | Hubbard | 248/75 X |

*Primary Examiner*—J. Franklin Foss

*Attorney, Agent, or Firm*—Malloy, Downey & Malloy

[57] ABSTRACT

A support assembly for a spray nozzle specifically structured to deliver liquid and/or cleaning chemicals under high pressure to air conditioning coils of large commercial-type air conditioning units for the cleaning thereof in order to render operation of the entire air conditioning assembly more efficient. The spray nozzle is adjustably and removably positioned relative to the air conditioning coils being cleaned thereby eliminating the need for personnel to physically handle and position the spray nozzle during the cleaning process wherein the presence of personnel is extremely costly as well as being dangerous and hazardous to the health of the personnel due to the enclosed and resulting harsh environmental conditions under which such cleaning of air conditioning coils normally takes place.

5 Claims, 1 Drawing Sheet

SUPPORT AND POSITIONING ASSEMBLY FOR A SPRAY NOZZLE

This application is a division of present co-pending application Ser. No. 07/302,487, filed on Jan. 27, 1989, now Pat. No. 4,988,063.

BACKGROUND OF THE INVENTION

1. Field of the Invention

This invention relates to an assembly for the adjustable support and selective positioning of a high pressure spray nozzle intended to deliver cleaning liquid to the coils of large industrial size air conditioning assemblies of the type associated with large buildings, such as airports, convention centers, sports arenas, etc.

2. Description of the Prior Art

Air conditioning facilities for large indoor areas such as airports, assembly halls, sports arenas, commercial buildings, theatres, etc. involve the use of extremely large cooling coils generally defined by a plurality of aluminum fins disposed in immediate adjacent side-by-side relation to one another. The continued use of such air conditioning facilities over a prolonged period of time naturally involves periodic cleaning and like maintenance to ensure that the air conditioning facility work at peek efficiency. This prolonged, continued use requires constant maintenance of the air conditioning facility in order to maintain efficient operation. One specific task which needs to be done during the regular maintenance of these air conditioning facilities is the cleaning of the fin-type coils. However, the cleaning of these coils is no easy task and presents a number of well-recognized problems. To clean the coils, typically a high-pressure spray nozzle issuing water or applicable cleaning fluid is directed at the coils in order to remove any accumulated dust, dirt, and other substances from between the fin-like configurations. Thus, it is necessary that the cleaning liquid spray outwardly from the spray nozzle under significantly high pressure in order that it can penetrate through the rather narrow, confined areas between the coils. One common problem associated with the coil cleaning is the manipulation and maintenance of the spray nozzle so as to efficiently reach all portions of the coils to be cleaned. Because the coils are usually located in a confined, difficult to reach area, it is extremely difficult for personnel operating and handling the spray nozzle to remain in position for any prolonged period of time. Adding to the harsh environmental condition in which such spray nozzles must operate is the fact that frequently the coils are cleaned by liquid and/or steam at dangerously high temperatures. Accordingly, there is an obvious need for a support and positioning assembly capable of positioning the high pressure nozzle in a preferred position and location relative to their impingement of cleaning fluid directly on the coils to be cleaned in such a manner which allows a spray nozzle to be easily adjusted so as to effectively clean all areas of the coil. Such a support assembly for use with high pressure spray nozzles would thereby eliminate the need for personnel to physically handle the cleaning equipment during cleaning and further eliminating the need to remain in the cleaning area for any prolonged period of time.

There are numerous types of structures in the prior art designed to hold various types of spray nozzles. The majority of these support assemblies are directed to the positioning and maintaining of a garden hose type structure for the watering of lawns or like ground service areas. Such U.S. Pat. Nos. include 807,184; 684,220; 916,255; 1,590,910; 2,031,278; 2,045,336; and 3,645,484. It should be emphasized that the structures disclosed in the above-noted patents are presented as being representative only of prior art development and none of the assemblies in these patents are believed to perform the function, service, and utility of a preferred support assembly which is necessary to maintain a high pressure spray nozzle in direct cleaning relation to fin type air conditioning coils.

SUMMARY OF THE INVENTION

The present invention relates to a support and positioning assembly for a high pressure cleaning nozzle designed to deliver a higher pressure of cleaning fluid such as water, chemicals, steam, etc. onto air conditioning coils of the type utilized in large commercial-type air conditioning facilities. Cleaning of the coils, as set forth above, is a necessity in order to operate the air conditioning facility efficiently and eliminate strain on the compressure or drive motors as when the air conditioning facility is operated with dirty, clogged coils. The preferred embodiment in the present invention includes a base portion having an elongated configuration and a support portion defined by two support members secured to opposite ends of the base. The support portions are adjustably disposed outwardly from the base in co-axial relation thereto and into engaging relation with oppositely disposed, substantially parallel wall surfaces or like support surfaces. This support portion on the base is similar to the support assembly found on a shower curtain rod, however, the support portion of the present invention has obvious structural differences.

In the preferred embodiment, a connecting means comprises a connecting sleeve which is either manually or automatically positioned along the length of the base. The mounting means in the above-noted preferred embodiment includes a mounting sleeve concentrically surrounding and supporting the length of the spray nozzle therein. The spray nozzle may be selectively positioned along its length relative to the sleeve to vary its location. A mounting finger has one end secured to the connecting sleeve of the afore-mentioned connecting means and extends outwardly therefrom to an opposite end which is connected to the mounting sleeve. The mounting sleeve is rotatable along the longitudinal axis of the finger relative to the connecting sleeve and base.

A congruent multi-sided configuration is present in both the cross-sectional configuration of the base and the cross-sectional configuration of the connecting sleeve so as to prevent relative rotation therebetween. This prevention of relative rotation will overcome any tendency of the spray nozzle to exert a twisting force or torque on the connecting sleeve relative to the base when the cleaning fluid issues from the spray nozzle under a sufficiently high pressure.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
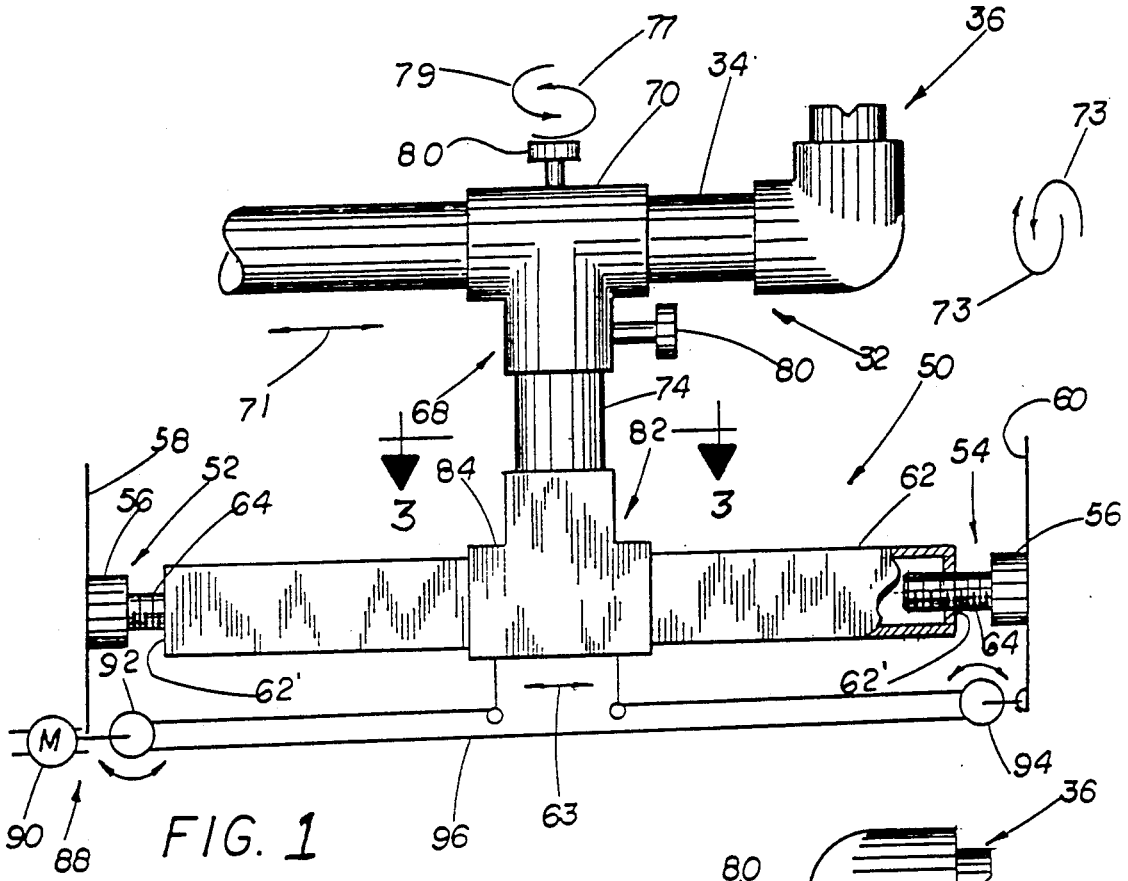
FIG. 1 is a top view of the preferred embodiment of the present invention.
Figure 2:
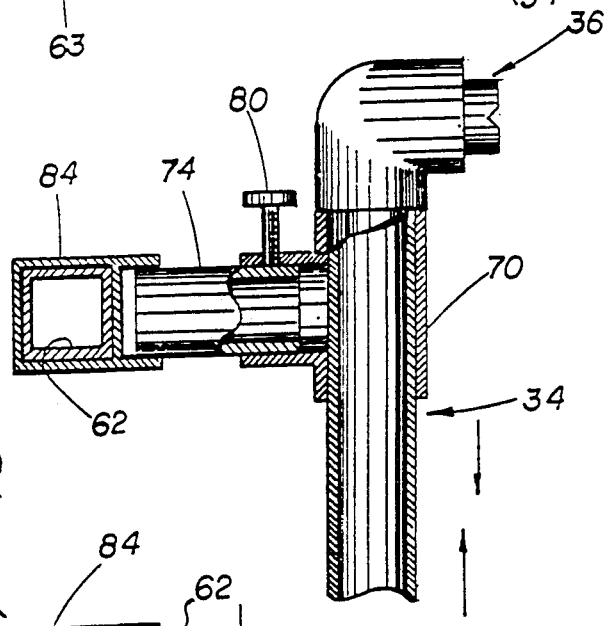
FIG. 2 is a sectional view of a partial cutaway of the embodiment of FIG. 1.
Figure 3:
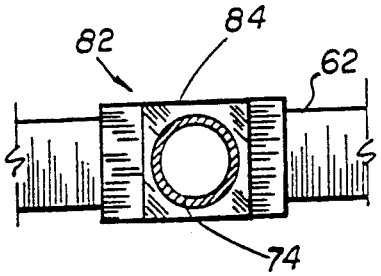
FIG. 3 is a sectional view along lines 3—3 of FIG. 2.

Referring to FIGS. 1-3, the present invention is directed towards a support and positioning assembly generally indicated as 50. In the preferred embodiment, the support portion comprise two support assemblies generally indicated as 52 and 54 each having a securement member 56 forced into abutting, gripping engagement with a wall or like supporting surface 58 and 60 and being adjustably mounted so as to exert longitudinally outward from opposite ends of the base 62. Such longitudinal adjustment may comprise an exteriorally threaded stub shaft 64 attached to each of the securement members 56 and being connected in threaded engagement with the end portion 62' of the base 62 as shown. Referring to FIG. 1, the support assembly includes a mounting assembly generally indicated as 68 including a mounting sleeve 70 concentrically disposed in supporting engagement about the exterior surface of the elongated pipe 34 of the spray nozzle 32. The length of the spray pipe 34 may be longitudinally adjustable within the sleeve 70 in accordance with directional arrows 71 or may be rotated relative to a mounting finger 74 in each of two opposite directions in accordance with the directional arrows 73. The mounting finger 74 is connected at one end to the mounting sleeve 70, wherein the mounting sleeve 70 is rotatable relative thereto as indicated by directional arrows 77 and 79. A pair of set screws 80 or like connectors may be utilized to maintain fixed positions between the mounting sleeve 70 and the mounting finger 74.

A connecting means is generally indicated as 82 and includes a connecting sleeve 84 concentrically disposed about the exterior surface of the base 62 and movable along the length thereof in each of two opposite directions as indicated by the directional arrows 63. Both the interior surface of the connecting sleeve 84 and the exterior surface of the base 62 are defined by congruent multi-sided configurations which prevent relative rotation between these two elements.

While the connecting sleeve 84 may be moved manually along the length of the base 62, another embodiment contemplates an automatic positioning or driving means generally indicated as 88 including a drive motor 90 connected to a drive pulley 92 secured preferably to one of the surfaces, 58 or 60. A cable arrangement is interconnected between the drive pulley and a driven pulley 94 with opposite free ends of the cable mounting 6 being connected to the connecting sleeve 84. Activation of the drive motor 90 in either of two opposite directions causes the connecting sleeve 84 and accordingly the attached spray nozzle 32 to be moved along the base 62 to a desired location for a proper cleaning.

Now that the invention has been described,

What is claimed is:

1. For use in cleaning fin type air conditioning unit coils, a cleaning spray nozzle support and positioning assembly including a cleaning nozzle means to spray cleaning fluid under pressure on the coils, said cleaning nozzle means including a nozzle and an extending tubular portion, said assembly comprising:

an elongate supporting base extending in spaced relation along the coils and means fixing said base to a support surface, a nozzle carrier means movably connected to the base for movement of translation along the base, said carrier means including orienting means to selectively orient the nozzle means to direct cleaning fluid spray in a predetermined path and means to maintain the nozzle means in a selected orientation, said orienting means comprising a finger included on said carrier means extending away from the base, a nozzle means holding member rotatable on the finger, said member including a lateral sleeve portion about the extending tubular portion of said nozzle means, said extending tubular portion being rotatable in said sleeve for swinging movement of said nozzle, said means to maintain comprising means to mutually engage the finger and the nozzle holding member to lock the finger and holding member in a selected position and means to mutually engage the nozzle holding member and the extending tubular portion of said nozzle means to lock the nozzle in an adjusted position, whereby, when oriented and locked in position, said carrier means and nozzle may be moved along said base to spray and clean said fin type coils.

2. A cleaning spray nozzle support and positioning assembly as set forth in claim 1 wherein said means fixing said elongate base includes means at one end of the base to fix the base to a vertical support surface.

3. A cleaning spray nozzle support and positioning assembly as set forth in claim 1 wherein said means fixing said elongate base are provided at each end of said base to fix said base to a vertical support surface.

4. A cleaning spray nozzle support and positioning assembly as set forth in claim 1 including drive motor and connecting linkage means are provided in driving relation to said carrier means to move said carrier means cyclically along said base.

5. A cleaning spray nozzle support and positioning assembly as set forth in claim 4 wherein said connecting linkage comprises a cable and pulling system secured in driving relation to said motor and attached in driving relation to said carrier means, said motor being reversibly driven and said carrier means selectively positionable in opposite directions along the length of said base upon activation of said drive motor.

* * * * *